US010009700B1

(12) United States Patent
Pan et al.

(10) Patent No.: US 10,009,700 B1
(45) Date of Patent: Jun. 26, 2018

(54) SYSTEM AND METHOD FOR FUZZY LOGIC FEEDBACK CONTROL OF SPEAKER EXCURSION

(71) Applicant: Nuvoton Technology Corporation, Hsinchu (TW)

(72) Inventors: Guanhong Pan, San Jose, CA (US); Yaoching Liu, San Jose, CA (US)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days. days.

(21) Appl. No.: 15/650,967

(22) Filed: Jul. 16, 2017

(51) Int. Cl.
*H04R 29/00* (2006.01)
*H04R 3/00* (2006.01)

(52) U.S. Cl.
CPC ..... *H04R 29/001* (2013.01); *H04R 3/00* (2013.01); *H04R 3/002* (2013.01); *H04R 3/007* (2013.01)

(58) Field of Classification Search
CPC ..... H04R 3/002; H04R 3/007; H04R 29/001
See application file for complete search history.

(56) References Cited

U.S. PATENT DOCUMENTS 5,548,650 A * 8/1996 Clark ..... H03G 11/00 381/100
8,194,869 B2 * 6/2012 Mihelich ..... H04R 3/002 381/58
8,995,673 B2 * 3/2015 Mihelich ..... H04R 3/002 381/55
9,516,443 B2 * 12/2016 Risberg ..... H04R 3/002
9,807,502 B1 * 10/2017 Hatab ..... H04R 3/04
2011/0228945 A1 * 9/2011 Mihelich ..... H04R 3/002 381/59
2012/0237045 A1 * 9/2012 Mihelich ..... H04R 3/002 381/59
2014/0348336 A1 * 11/2014 Tong ..... H04R 29/001 381/59
2015/0010168 A1 * 1/2015 Cheng ..... H04R 3/002 381/107

* cited by examiner

*Primary Examiner* — Duc M Nguyen
(74) *Attorney, Agent, or Firm* — Kilpatrick Townsend & Stockton LLP

(57) ABSTRACT

An audio system includes an input node for receiving an audio input signal, a signal processor coupled to the input node to receive the audio input signal, and an output node for providing an audio output signal to a speaker. The audio system includes a first fuzzy logic controller configured to receive sampled signals related to the audio input signal and a gain of the signal processor, the first fuzzy logic controller configured to determine a risk level of the audio output signal. The audio system also includes a second fuzzy logic controller configured to receive feedback signals related to the audio output signal and to determine a correction factor. Further, the audio system is configured to determine a control signal based on the risk level and the correction factor, and to adjust the audio output signal based on the control signal.

20 Claims, 11 Drawing Sheets

SYSTEM AND METHOD FOR FUZZY LOGIC FEEDBACK CONTROL OF SPEAKER EXCURSION

BACKGROUND OF THE INVENTION

This invention relates to the field of semiconductor technology. More particularly, embodiments of this invention are directed to methods and systems for the control of speakers in an audio system.

In order to achieve high volume of the loudspeaker in portable devices which have small sizes, the drive units are often driven hard to their mechanical limit. Hence the excessive diaphragm excursion and high voice coil temperature are the two main causes of loudspeaker failure. In conventional devices, a high pass filter is often employed to reduce the low-frequency components, which can cause large movements of the speaker diaphragm. However, this can degrade the sound quality, since too much of the bass sounds are cut.

Therefore, improved methods and systems that address some of the limitations described above are desired.

BRIEF SUMMARY OF THE INVENTION

A system and a method are provided for speaker excursion control using fuzzy logic to control the audio output signal based on not only the audio system parameters, but also include feedback signals from the audio output signals. For example, in some embodiments, two fuzzy logic controllers are used to control the audio output signals based on the feedback current value, feedback voltage value, low-frequency content, and gain of the speaker. Compared with the conventional solution using high pass filters, this claim can achieve more realistic sound quality without causing damage to the loudspeaker.

According to some embodiments of the present invention, an audio system for loudspeaker excursion control includes an input node for receiving an audio input signal, an output node for providing an audio output signal, and a signal processor for receiving the audio input signal and providing the output audio signal. The signal processor includes an analog-to-digital converter (ADC), a digital signal processing unit, a digital-to-analog converter (DAC), an audio amplifier, and a speaker. The audio system also has a low-frequency and gain sampling unit for providing a low-frequency component of the audio input signal and a current gain of the audio system. The audio system also has a feedback sampling unit for providing a feedback current signal and a feedback voltage signal derived from the output node. A first fuzzy logic controller is configured to receive the low-frequency component of the audio input signal and the current gain of the audio system, and to determine a risk level of the audio output signal with respect to speaker excursion. A second fuzzy logic controller is configured to receive the feedback voltage signal and the feedback current signal, and to determine a correction factor. The audio system is configured to determine a control signal based on the risk level and the correction factor, and to provide the control signal to the signal processor for adjusting the audio output signal.

According to some embodiments of the present invention, an audio system includes an input node for receiving an audio input signal, a signal processor coupled to the input node to receive the audio input signal, and an output node for providing an audio output signal to a speaker. The audio system includes a first fuzzy logic controller configured to receive sampled signals related to the audio input signal and a gain of the signal processor, the first fuzzy logic controller configured to determine a risk level of the audio output signal. The audio system also includes a second fuzzy logic controller configured to receive feedback signals related to the audio output signal and to determine a correction factor. Further, the audio system is configured to determine a control signal based on the risk level and the correction factor, and to adjust the audio output signal based on the control signal.

According to some embodiments of the present invention, a method is provided for speaker control, for example, loudspeaker excursion control, in an audio system configured to receive an audio input signal and provide an audio output signal to a speaker. The method includes providing sampled signals related to the audio input signal and a gain of the audio system to a first fuzzy logic controller. The sampled signals are processed in the first fuzzy logic controller to provide a risk level associated with the speaker. The method also includes providing feedback signals related to the audio output signal to a second fuzzy logic controller. The feedback signals are processed in the second fuzzy logic controller to provide a correction factor. The method also includes determining a control signal based on the risk level and the correction factor. The control signal is then provided to the audio system for adjusting the audio output signal.

A further understanding of the nature and advantages of the present invention may be realized by reference to the remaining portions of the specification and the drawings.

DETAILED DESCRIPTION OF THE INVENTION

The description below makes reference to a series of drawing figures enumerated above. These diagrams are merely examples, and should not unduly limit the scope of the claims herein. In connection with the various aspects illustrated and described, one of ordinary skill in the art would recognize other variations, modifications, and alternatives.

Figure 1:
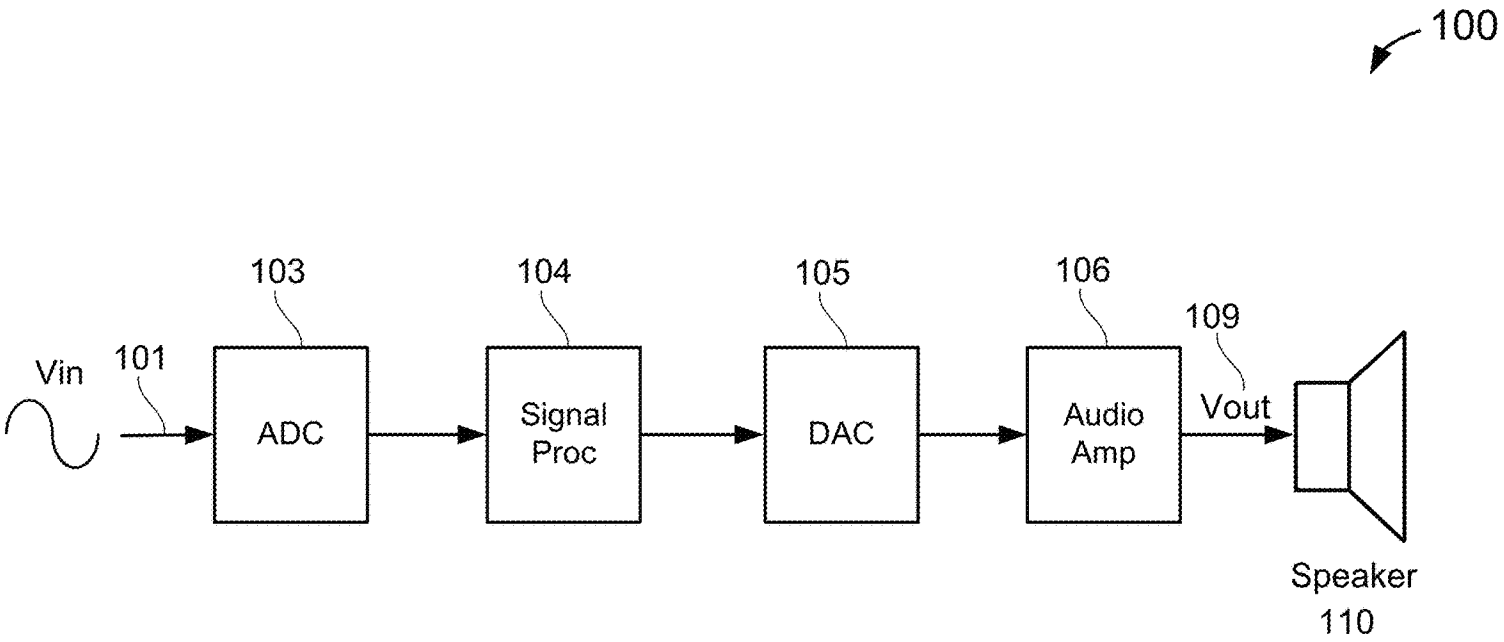
FIG. 1 (Prior Art)
FIG. 1 is a block diagram illustrating a conventional audio system.

FIG. 1 is a block diagram illustrating a conventional audio system. As shown in FIG. 1, audio system 100 is configured to receive an audio input signal Vin (101) and to provide an audio output signal Vout (109) to a speaker 110. Audio system 100 includes an analog-to-digital converter (ADC) 103, a digital signal processing unit 104, a digital-to-analog converter 105, and an audio amplifier unit 106. The functions of these components are not explained in detail here.

Figure 2:
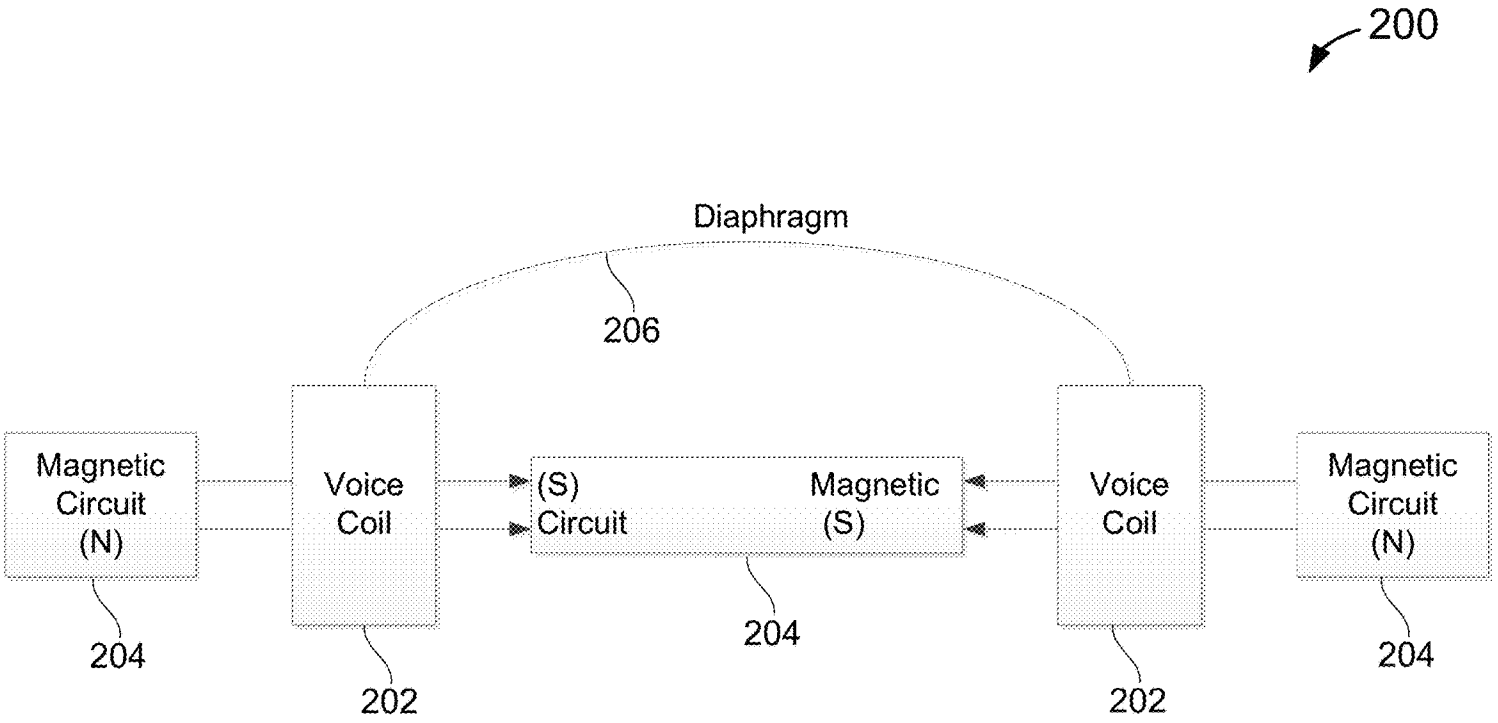
FIG. 2 is a block diagram illustrating a loudspeaker according to embodiments of the present invention.

FIG. 2 is a block diagram illustrating a loudspeaker 200 according to embodiments of the invention. Loudspeaker 200 can be used as speaker 110 in audio system 100 in FIG. 1. Loudspeaker 200 includes voice coils 202, magnetic circuit units 204, and a diaphragm 206. Voice coils 202 are attached to diaphragm 206. A magnetic field is generated across the voice coil by a permanent magnet via magnetic circuit 204. If the voice coil are pushed too hard, it can lead to excessive diaphragm excursion, which can cause loudspeaker failure. Loudspeaker failure can also be caused by voice coil overheating. For example, when the diaphragm is driven hard in order to get a high volume, the temperature inside the speaker can rise quickly and cause the glue in the voice coil to melt.

In embodiments of the invention, a system and a method are provided for speaker excursion control using fuzzy logic to control the diaphragm excursion based on not only the audio system parameters, but also include feedback signals from the audio output signals. For example, in some embodiments, two fuzzy logic controllers are used to control the audio output signals based on feedback current value, feedback voltage value, low-frequency content, and gain of the speaker. Compared with the conventional solution using high pass filters, this claim can achieve more realistic sound quality without causing damage to the loudspeaker.

In some embodiments, an audio system includes an input node for receiving an audio input signal, a signal processor coupled to the input node to receive the audio input signal, and an output node for providing an audio output signal to a speaker. The audio system includes a first fuzzy logic controller configured to receive sampled signals related to the audio input signal and a gain of the signal processor, the first fuzzy logic controller configured to determine a risk level of the audio output signal. The audio system also includes a second fuzzy logic controller configured to receive feedback signals related to the audio output signal and to determine a correction factor. Further, the audio system is configured to determine a control signal based on the risk level and the correction factor, and to adjust the audio output signal based on the control signal.

Figure 3A:
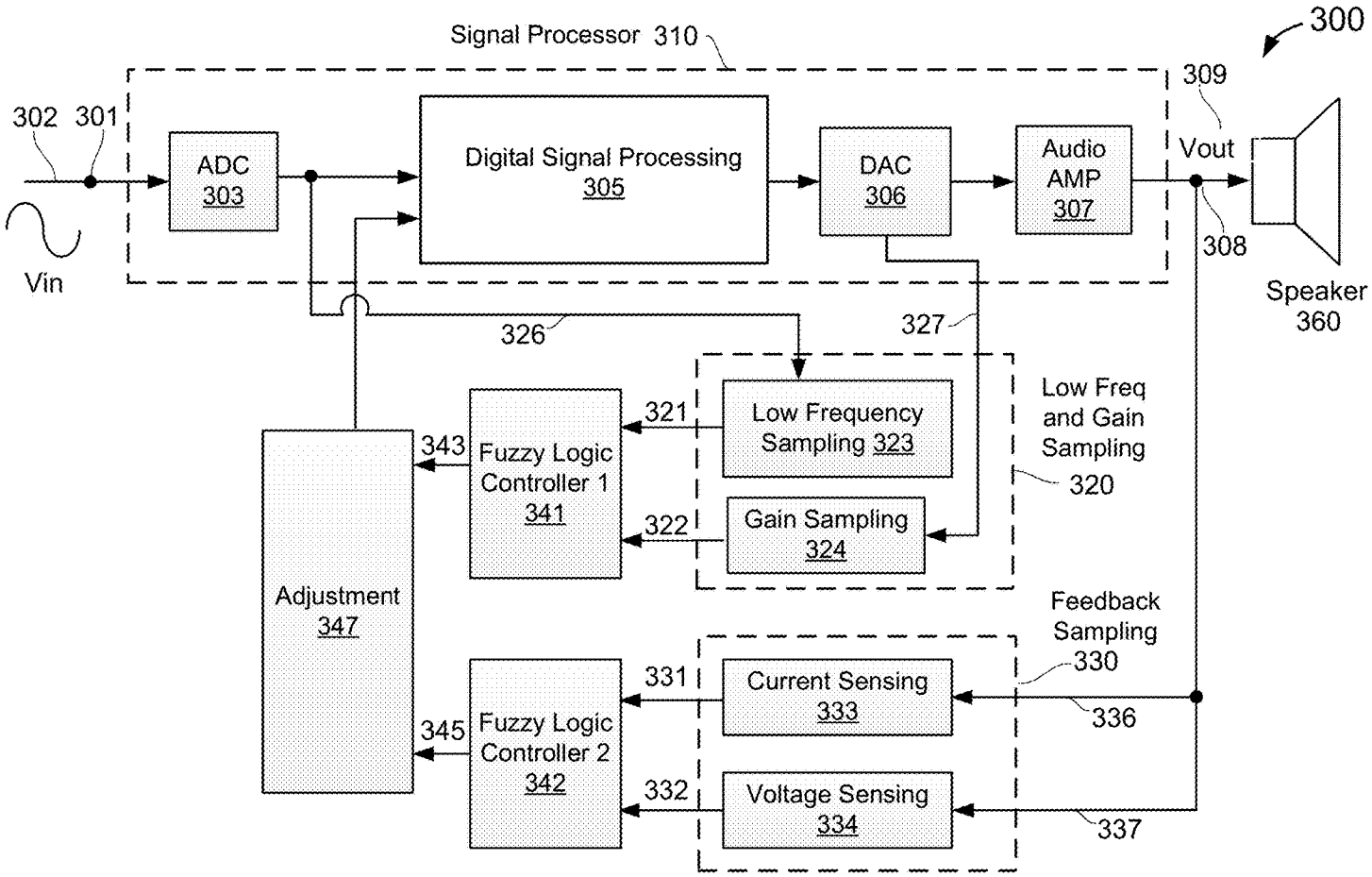
FIG. 3A is a block diagram illustrating an audio system for controlling a speaker according to embodiments of the present invention.
Figure 3B:
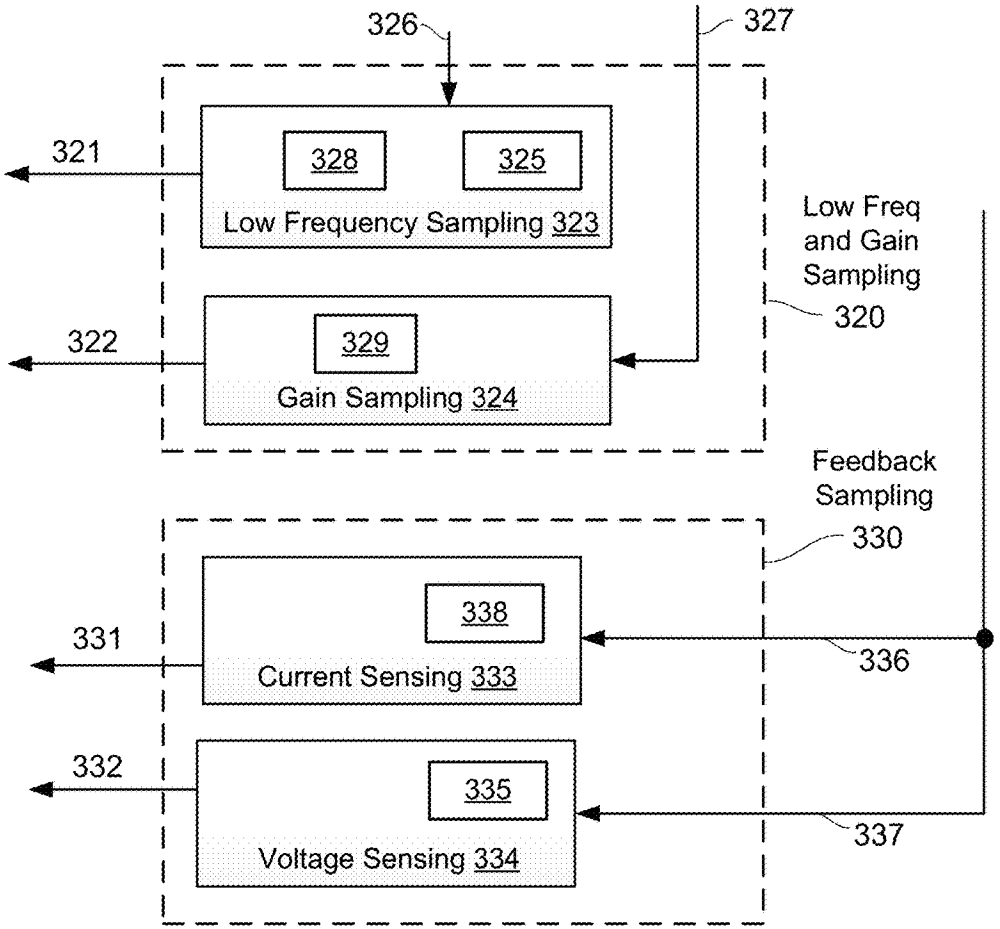
FIG. 3B is a block diagram illustrating certain functional units in the audio system of FIG. 3A according to embodiments of the invention.

FIG. 3A is a block diagram illustrating an audio system for controlling a speaker according to embodiments of the invention. FIG. 3B is a block diagram illustrating certain functional units in the audio system of FIG. 3A according to embodiments of the invention. As shown in FIG. 3A, audio system 300 includes an input node 301 for receiving an audio input signal 302, an output node 308 for providing an audio output signal 309 to a speaker 360, and a signal processor 310 for receiving the audio input signal 302 and providing the output audio signal 309. The signal processor can include an analog-to-digital converter (ADC) 303, a digital signal processing unit 305, a digital-to-analog converter (DAC) 306, an audio amplifier 307.

Audio system 300 also includes a low-frequency and gain sampling unit 320 for providing a low-frequency component 321 of the audio input signal and a current gain 322 of the audio system. In an embodiment, low-frequency and gain sampling unit 320 can include a low-frequency sampling unit 323 and a gain sampling unit 324. As shown in FIG. 3B, low-frequency sampling unit 323 can includes a low-pass filter 325 and a processing unit 328 to receive a signal 326 from ADC 303 and to determine the low-frequency component 321 of the audio input signal. In the low-frequency sampling unit 323, processing unit 328 is configured to compute the low-frequency component 321, which can include a short-term power of the low-frequency component, a long-term power of the low-frequency component, and a deviation of the low-frequency component that is a difference between the short-term power and the long-term power of the low-frequency component. The gain sampling unit 324 is coupled to DAC (Digital-to-Analog Converter) 306 in the signal processor to receive a gain 327 of DAC 306. Gain sampling unit 324 includes a processing unit 329 and is configured to determine gain values 322 of DAC 306. For example, processing unit 329 is configured to computer gain values 322 including a short-term power of gain values, a long-term power of gain values, and a deviation of gain values which is a difference between the short-term power of gain values and the long-term power of gain values.

Audio system 300 also includes a feedback sampling unit 330 for providing a feedback current signal 331 and a feedback voltage signal 332 derived from the output node 308. As shown in FIG. 3B, the feedback sampling unit 330 further includes a voltage sensing circuit 335 configured to measure a voltage provided to the speaker at the output node 308. The feedback sampling unit 330 also includes a current sensing circuit 338 configured to measure a current provided to the speaker at the output node 308.

As shown in FIG. 3A, audio system 300 also has a first fuzzy logic controller 341 configured to receive the low-frequency component of the audio input signal 321 and the current gain of the audio system 322, and to determine a risk level 343 of the audio output signal with respect to speaker excursion. The first fuzzy logic controller 341 is a predicative and regulates system which monitors the contents of the audio streams and hardware settings to avoid the speaker being over driven. Audio system 300 also has a second fuzzy logic controller 342 configured to receive the feedback current signal 331 and the feedback voltage signal 332, and to determine a correction factor 345. The second fuzzy logic controller 342 is an error correction system which monitors the measurements of sensing voltage and current on speakers and then does appropriate adjustments of the system. Audio system 300 also has an adjustment unit 347 that is configured to determine a control signal 349 based on the risk level 343 and the correction factor 345. Control signal 349 is provided to signal processor 310 for adjusting the audio output signal 309.

In embodiments of the invention, a fuzzy logic system includes linguistic variables as input or output variables of the system whose values are expressed in words or sentences from a natural language instead of numerical values. For example, in the first fuzzy logic controller 341, an input vector N[i] can include linguistic variables such as the long-term low-frequency (LTLFE), deviation of the low-frequency energy (LFEDEV) between long-term low-energy frequency energy and short-term low-frequency energy, long-term averaged DAC gain values (LTAVDAC), and deviation of long-term averaged DAC gain values (DACDEV) and short-term averaged DAC gain values. The first fuzzy logic controller 341 also has a linguistic variable in the output vector M[j]: risk level (RL), which is related to the risk level of speaker excursion causing damages to the speaker. Input vector N[i] and output vector M[j] are listed below.

$$N[i]=[\text{LTLFE, LFEDEV, LTAVDAC, DACDEV}]$$

$$M[j]=[RL]$$

Regarding the above linguistic variables, the term "long-term" is used to compare with "short-term," which represents how the signals change immediately. For example, in some embodiments, long-term means the signal is measured and maybe averaged over 1-5 milliseconds, and short-term means the signal is measured and maybe averaged over 1-50 microseconds, etc. In some embodiments, short-term can mean an audio sample of 48 Kbytes, which may last about 20 μsec, and long-term can mean 10 audio samples, which can last about 2 msec.

For LTLFE (long term low-frequency energy), the input signal is sampled by a low-pass filter, and then the long term power of the signal can be calculated based on attack time setting. The computation can be carried out in a digital signal processing unit using an iterative method. For example, in a specific embodiment, the long term power can be computed using the following formula, $$P_{a,long}=P_{a,long}\cdot(1-2^{VD_LTC-16})+|\text{Arin}|\cdot 2^{VD_LTC-16}+Th_P_{a,long}\cdot 2^{VD_LTC-17}$$

where $P_{a,long}$ is the long-term power, VD_LTC is the long term attack time, Arin is the input signal, $Th_P_{a,long}$ is the threshold of the long time energy. As used herein, "attack" is used to indicate the onset of a sound. A large value of VD_LTC indicates long-term, and a small value of VD_LTC indicates short-term.

The LFEDEV (deviation of the low-frequency energy) can be calculated as by the absolute value of the deviation or difference between the long term low frequency energy and short term low frequency energy. For LTACDAC (Long term averaged DAC gain values), can be computed using a formula similar to the above to calculate the long term gain change based on the current gain of the system in every measured sample. The DACDEV (deviation of the gain values) can be calculated by the absolute value of the deviation between the long term averaged DAC gain values and short term averaged DAC gain values. Of course, other known methods of computing signal power can also be used.

In some embodiments, the risk level can be used to vary the audio output signal to control speaker excursion. For example, an equalizer in the signal processor 310 can be configured for adjusting the balance between frequency components within an electronic signal, for example, in sound recording and reproduction. A equalizer can enhance or weaken the energy of specific frequency bands or "frequency ranges," boost and cut-off frequency parameters, etc. Referring to FIG. 3A, audio system 300 has an adjustment unit 347 configured to receive the risk level 343 and to provide a control signal 348 to digital signal processing unit 305 in signal processor 310 for adjusting the audio output signal 308.

In some embodiments, for input linguistic variables the long-term low-frequency energy (LTLFE) and deviation of the low-frequency energy (LFEDEV)), three linguistic labels (High, Medium, Low) are used to describe the membership functions. For long-term averaged DAC gain values (LTAVDAC) and deviation of the gain values (DACDEV), two linguistic labels (High, Low) are used to describe the membership functions. In these embodiments, LTLFE and LFEDEV are considered to be more critical to the risk level of the speaker than other input variables. For the output linguistic variable, risk level (RL), three linguistic labels (High, Medium, Low) are used to describe the membership functions.

In some embodiments, the crisp input values are normalized and mapped to fuzzy linguistic terms using the membership functions. For example, the deviation of the low-frequency energy (LFEDEV) can be defined as an 15-bit unsigned number. Then every sample of the deviation of the low-frequency energy of the input signal can be normalized to a value between 0 and 1 according to the following formula:

$$LFEDEV_N=\frac{LFEDEV}{2^{15}-1}$$

Other membership functions can be defined similarly.

Figure 4:
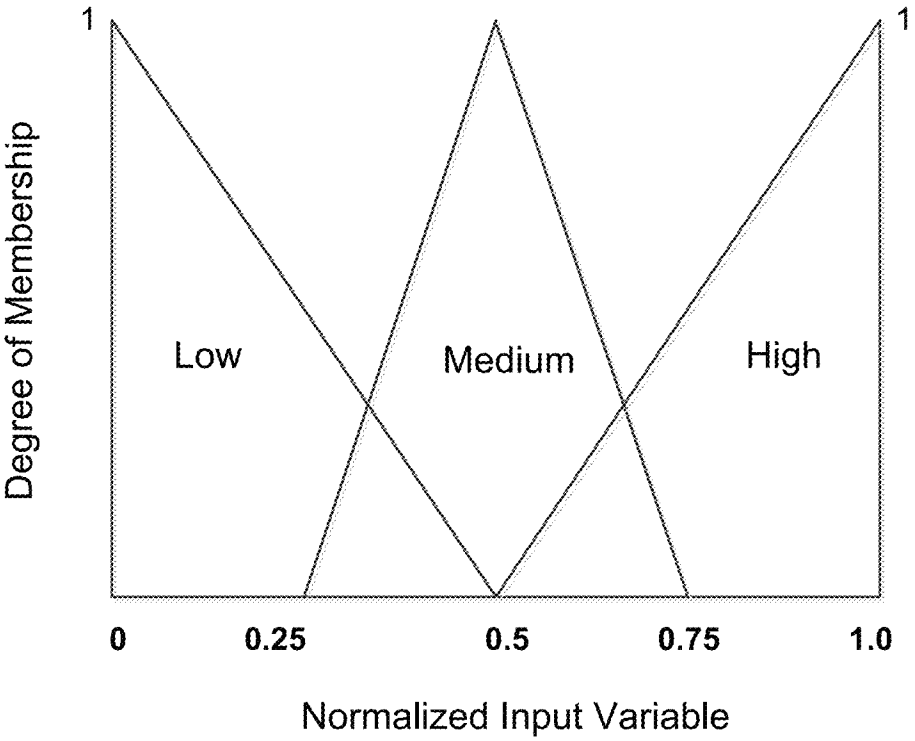
FIG. 4 is a diagram of fuzzy logic membership functions for certain input linguistic variables in the audio system of FIG. 3 according to embodiments of the present invention.

FIG. 4 is a diagram of fuzzy logic membership functions for input linguistic variables (LFEDEV), which represent the deviation of the low-frequency energy, and long-term low-frequency energy (LTLFE) according to some embodiments of the present invention. In FIG. 4, the horizontal axis shows the normalized deviation of the low-frequency energy, $LFEDEV_N$, and the vertical axis shows the degree of membership. Three linguistic labels High, Medium, and Low are used to describe the membership function for this linguistic variable. For example, a value of $LFEDEV_N$ between 0-0.25 can be taken as 100 percent Low. An LFEDEV value of 0.75 to 1 can be taken as 100 percent High. A value of $LFEDEV_N$ between 0.25 to 0.75 can be taken as a combination of a certain percent of Low and a certain percentage of Medium or a combination of a certain percentage of Medium and a certain percentage of High. For example, a normalized value of a input linguistic variable between 0.25-0.50 can be taken as a combination of a certain percent of Low and a certain percentage of Medium. Similarly, a normalized value of a input linguistic variable between 0.0.50-0.75 can be taken as a combination of a certain percent of Medium and a certain percentage of High.

Figure 5:
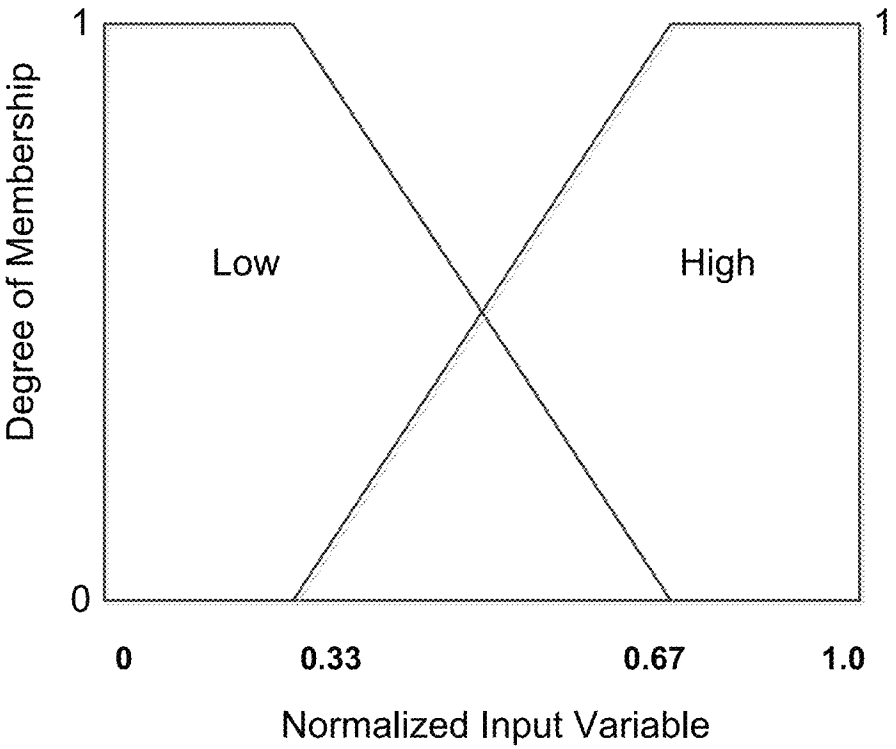
FIG. 5 is another diagram of fuzzy logic membership functions for certain input linguistic variables in the audio system of FIG. 3 according to embodiments of the present invention.

FIG. 5 is a diagram of fuzzy logic membership functions for input linguistic variables long-term averaged DAC gain values (LTAVDAC) and deviation of the gain values (DACDEV) according to some embodiments of the present invention. In FIG. 5, the horizontal axis shows the normalized LTAVDAC or DACDEV, and the vertical axis shows the degree of membership. Two linguistic labels High and Low are used to describe the membership function for this linguistic variable. For example, a value of normalized LTAVDAC or DACDEV between 0-0.33 can be taken as 100 percent Low. A value of normalized LTAVDAC or DACDEV between 0.67 to 1 can be taken as 100 percent High. A value of normalized LTAVDAC or DACDEV between 0.33 to 0.67 can be taken as a combination of a certain percent of Low and a certain percentage of High.

Figure 6:
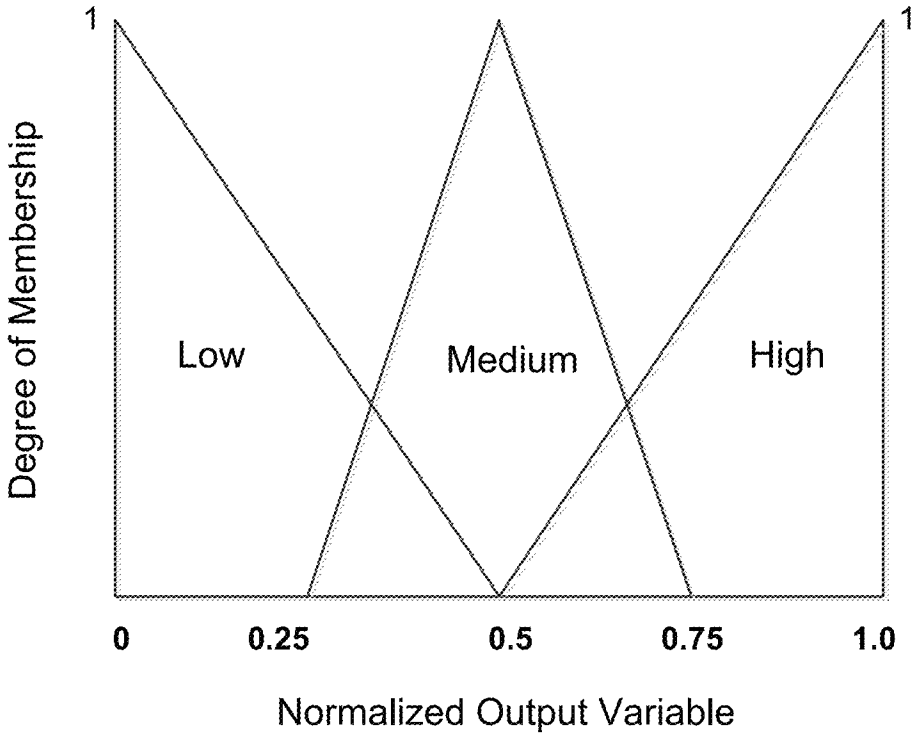
FIG. 6 is a diagram of fuzzy logic membership functions for an output linguistic variable in the audio system of FIG. 3 according to embodiments of the present invention.

FIG. 6 is a diagram of fuzzy logic membership functions for output linguistic variable risk level (RL) according to some embodiments of the present invention. In FIG. 6, the horizontal axis shows the normalized risk level (RL), and the vertical axis shows the degree of membership. Three linguistic labels, High, Medium, and Low, are used to describe the membership function for this linguistic variable. For example, a value of risk level (RL) between 0-0.25 can be taken as 100 percent Low. An RL value of 0.75 to 1 can be taken as 100 percent High. A value of RL between 0.25 to 0.75 can be taken as a combination of a certain percent of Low and a certain percentage of Medium or a combination of a certain percentage of Medium and a certain percentage of High.

As described above, FIG. 6 shows the membership functions of the output linguistic variable, the risk level (RL). By knowing the risk level, the audio system, e.g., an equalizer in the system, can be tuned to lower the risk level or set a higher volume. For example, if the risk level is very high, then the system should decrease the gain and cut off more low-frequency items to lower the risk level. But if the risk level is very low, the equalizer should increase the gain and enhance the bass part to have a better sound quality.

In fuzzy logic controller 1, the input linguistic variables are LTLFE, LFEDEV, LTAVDAC, DACDEV, and the output linguistic variable is RL (risk level). As described above, LTLFE and LFEDEV have three linguistic label values, and LTAVDAC and DACDEV have two linguistic label values. Therefore, there are 36 [3*3*2*2] combinations of input linguistic label values. Accordingly, a set of 36 [3*3*2*2] fuzzy rules are constructed to control the output variable risk level (RL). A partial listing of the fuzzy rules for the first fuzzy logic controller 342 is listed below.

IF LTLFE is High and LFEDEV is High and LTAVDAC is High and DACDEV is High, THEN RL is High.

IF LTLFE is High and LFEDEV is High and LTAVDAC is High and DACDEV is Low, THEN RL is High.

IF LTLFE is Medium and LFEDEV is Medium and LTAVDAC is High and DACDEV is Low, THEN RL is Medium.

IF LTLFE is Medium and LFEDEV is Medium and LTAVDAC is Low and DACDEV is High, THEN RL is Medium.

IF LTLFE is Low and LFEDEV is Low and LTAVDAC is High and DACDEV is Low, THEN RL is Low.

IF LTLFE is Low and LFEDEV is Low and LTAVDAC is Low and DACDEV is Low, THEN RL is Low.

Table I lists the fuzzy rules in the first fuzzy logic controller 341 according to some embodiments.

TABLE I

Fuzzy Rules in the First Fuzzy Logic Controller

| LTLFE | LFEDEV | LTAVDAC | DACDEV | Risk Level |
|---|---|---|---|---|
| High | High | High | High | High |
| High | High | High | Low | High |
| High | High | Low | High | High |
| High | High | Low | Low | Medium |
| High | Medium | High | High | High |
| High | Medium | High | Low | High |
| High | Medium | Low | High | High |
| High | Medium | Low | Low | Medium |
| High | Low | High | High | High |
| High | Low | High | Low | Medium |
| High | Low | Low | High | Medium |
| High | Low | Low | Low | Low |
| Medium | High | High | High | High |
| Medium | High | High | Low | High |
| Medium | High | Low | High | High |
| Medium | High | Low | Low | Medium |
| Medium | Medium | High | High | High |
| Medium | Medium | High | Low | Medium |
| Medium | Medium | Low | High | Medium |
| Medium | Medium | Low | Low | Low |

TABLE I-continued

Fuzzy Rules in the First Fuzzy Logic Controller

| LTLFE | LFEDEV | LTAVDAC | DACDEV | Risk Level |
|---|---|---|---|---|
| Medium | Low | High | High | Medium |
| Medium | Low | High | Low | Low |
| Medium | Low | Low | High | Low |
| Medium | Low | Low | Low | Low |
| Low | High | High | High | High |
| Low | High | High | Low | Medium |
| Low | High | Low | High | Medium |
| Low | High | Low | Low | Low |
| Low | Medium | High | High | Medium |
| Low | Medium | High | Low | Low |
| Low | Medium | Low | High | Low |
| Low | Medium | Low | Low | Low |
| Low | Low | High | High | Medium |
| Low | Low | High | Low | Low |
| Low | Low | Low | High | Low |
| Low | Low | Low | Low | Low |

Figure 7:
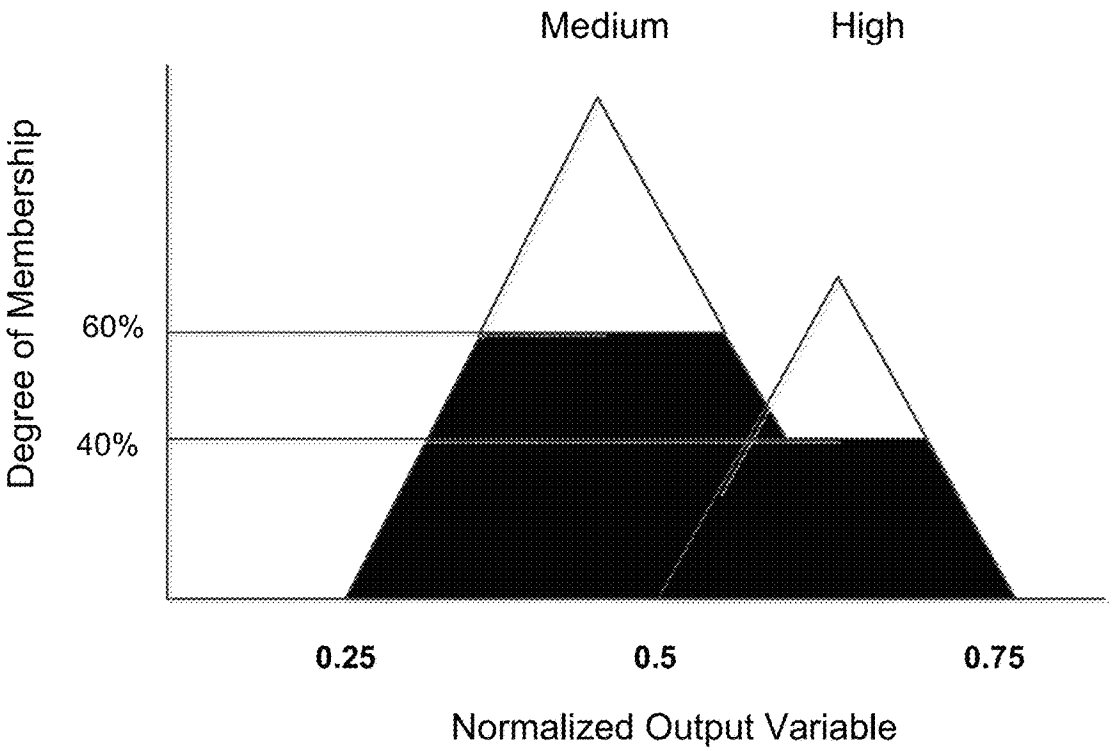
FIG. 7 is a diagram of fuzzy logic defuzzification function for an output linguistic variable in the audio system of FIG. 3 according to embodiments of the present invention.

Given the fuzzy rules and corresponding membership degrees, or membership function values, a fuzzy result which is described in terms of membership functions can be generated. Then defuzzification solution is needed to interpret the membership degrees of the fuzzy sets into a real values. In some embodiments of this invention, a center of gravity method is used as the defuzzification solution to get a crisp output, i.e., a specific value for a control signal. For example, as the fuzzy output, the risk level is 60% 'medium' and 40% 'high', then the 'medium' triangle will be cut 60% the way up from the bottom, and the 'high' triangle will be cut 40% the way up from the triangle. The resulting shape forms a trapezoid. FIG. 7 show an example for the defuzzification solution. The centroid of the area can be calculated as follow:

$$c = \frac{\int u(x) * x dx}{\int u(x) dx}$$

where x represents risk level in the horizontal axis and u(x) represents the degree of membership in the perpendicular axis, and c the value of x that represents the risk level (RL).

As described above, in some embodiments, the risk level can be used to vary the audio output signal to control speaker excursion. In FIG. 3A, audio system 300 has an adjustment unit 347 configured to receive the risk level 343 and to provide a control signal 348 to digital signal processing unit 305 in signal processor 310 for adjusting the audio output signal 308.

Referring back to FIG. 3A, in the second fuzzy logic controller 342, output voltage and current are monitored for further adjusting the system to protect the speaker. In some embodiments, both values can be processed by a low pass filter in voltage sensing block 333 or current sensing block 334 to avoid glitches which are defined as short-term values ($V_{savg}$, $I_{savg}$). For the sensed current, extract the long-term average values ($I_{lavg}$) which are also extracted from short-term values to indicate the trend of the current change. The second fuzzy logic controller 342 has a linguistic variable Correction Factor in the output vector, which is also referred to as Prediction error (PE).

Figure 8:
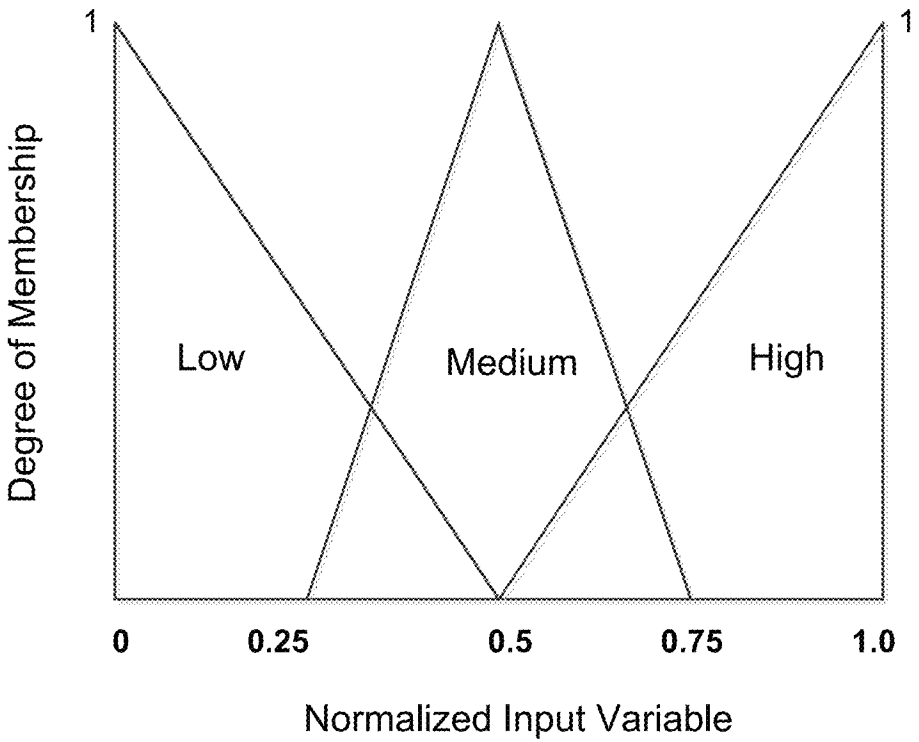
FIG. 8 is another diagram of fuzzy logic membership functions for certain input linguistic variables in the audio system of FIG. 3 according to embodiments of the present invention.

FIG. 8 is a diagram of fuzzy logic membership functions for input linguistic variables $V_{savg}$, $I_{savg}$, $I_{lavg}$ according to some embodiments of the present invention. In FIG. 8, the horizontal axis shows the normalized value of the input linguistic variable and the vertical axis shows the degree of membership. Three linguistic labels High, Medium, and Low are used to describe the membership function for this linguistic variable. For example, a value of an linguistic variable between 0-0.25 can be taken as 100 percent Low. A value of an linguistic variable between 0.75 to 1 can be taken as 100 percent High. A value of an linguistic variable between 0.25 to 0.75 can be taken as a combination of a certain percent of Low and a certain percentage of Medium or a combination of a certain percentage of Medium and a certain percentage of High. For example, a normalized value of a input linguistic variable between 0.25-0.50 can be taken as a combination of a certain percent of Low and a certain percentage of Medium. Similarly, a normalized value of an input linguistic variable between 0.0.50-0.75 can be taken as a combination of a certain percent of Medium and a certain percentage of High.

Figure 9:
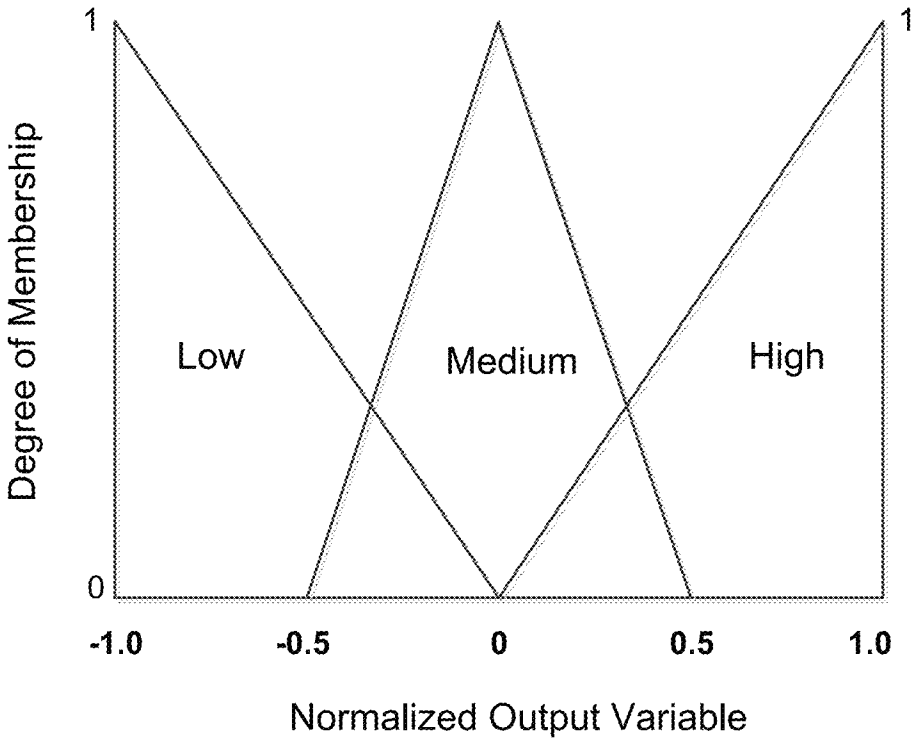
FIG. 9 is a diagram of fuzzy logic membership functions for another output linguistic variable in the audio system of FIG. 3 according to embodiments of the present invention.

FIG. 9 is a diagram of fuzzy logic membership functions for output linguistic variable correction factor (CF), also referred to as prediction error (PE), according to some embodiments of the present invention. In FIG. 9, the horizontal axis shows the normalized correction factor (CF) ranging from −1.0 to 1.0, and the vertical axis shows the degree of membership ranging from 0 to 1. Three linguistic labels, High, Medium, and Low, are used to describe the membership function for this linguistic variable. For example, a value of correction factor (CF) between −1.0 to −0.5 can be taken as 100 percent Low. APE value of 0.5 to 1.0 can be taken as 100 percent High. A value of correction factor (CF) between −0.5 to 0.5 can be taken as a combination of a certain percent of Low and a certain percentage of Medium or a combination of a certain percentage of Medium and a certain percentage of High.

In the second fuzzy logic controller 342, the input linguistic variables are $V_{savg}$, $I_{savg}$, $I_{lavg}$, and the output linguistic variable is PE (Prediction Error). As described above, each of the input linguistic variables has three linguistic label values. Therefore, there are 27 [3*3*3] combinations of input linguistic label values. Accordingly, a set of 27 fuzzy rules are constructed to control the output linguistic variable is the Correction Factor (CF) or PE (Prediction Error). A partial listing of the fuzzy rules for the second fuzzy logic controller 342 is listed below.

IF $V_{savg}$ is High and $I_{savg}$ is High and $I_{lavg}$ is High, THEN PE is High.

IF $V_{savg}$ is Medium and $I_{savg}$ is High and $I_{lavg}$ is High, THEN PE is High.

IF $V_{savg}$ is High and $I_{savg}$ is Medium and $I_{lavg}$ is Low, THEN PE is Medium.

IF $V_{savg}$ is Medium and $I_{savg}$ is Medium and $I_{lavg}$ is Medium, THEN PE is Medium.

IF $V_{savg}$ is Medium and $I_{savg}$ is Low and $I_{lavg}$ is Low, THEN PE is Low.

IF $V_{savg}$ is Low and $I_{savg}$ is Low and $I_{lavg}$ is Low, THEN PE is Low.

Table II lists a portion of the fuzzy rules in fuzzy logic controller 1 according to some embodiments.

TABLE II

Fuzzy Rules in the Second Fuzzy Logic Controller

| $V_{savg}$ | $I_{savg}$ | $I_{lavg}$ | Correction Factor |
|---|---|---|---|
| High | High | High | High |
| High | High | Medium | High |

TABLE II-continued

Fuzzy Rules in the Second Fuzzy Logic Controller

| $V_{savg}$ | $I_{savg}$ | $I_{lavg}$ | Correction Factor |
|---|---|---|---|
| High | High | Low | High |
| High | Medium | High | High |
| High | Medium | Medium | High |
| High | Medium | Low | Medium |
| High | Low | High | High |
| High | Low | Medium | Medium |
| High | Low | Low | Low |
| Medium | High | High | High |
| Medium | High | Medium | High |
| Medium | High | Low | Medium |
| Medium | Medium | High | Medium |
| Medium | Medium | Medium | Medium |
| Medium | Medium | Low | Medium |
| Medium | Low | High | Medium |
| Medium | Low | Medium | Low |
| Medium | Low | Low | Low |
| Low | High | High | High |
| Low | High | Medium | Medium |
| Low | High | Low | Low |
| Low | Medium | High | Medium |
| Low | Medium | Medium | Low |
| Low | Medium | Low | Low |
| Low | Low | High | Low |
| Low | Low | Medium | Low |
| Low | Low | Low | Low |

Given the above fuzzy rules and corresponding membership degrees, a fuzzy result which is described in terms of membership functions is generated. Then defuzzification solution similar to that described above in connection with FIG. 7 can be used to convert the membership degrees of the fuzzy sets into a real values. For example, as the fuzzy output, the correction factor or prediction error is 60% 'medium' and 40% 'high,' then the 'medium' triangle will be cut 60% the way up from the bottom, and the 'high' triangle will be cut 40% the way up from the triangle, then forms a trapezoid. The centroid of the area will be calculated as follow:

$$c = \frac{\int u(x) * x dx}{\int u(x) dx}$$

where x represents the correction factor in the horizontal axis and u(x) represents the degree of membership in the perpendicular axis, and c the value of x that represents the correction factor (CF) or prediction error (PE).

In some embodiments of the invention, the correction factor (CF) or prediction error (PE) can be used to adjust the Risk Level. If the sign of the correction factor is negative, then it means that the risk level predict in the first fuzzy logic controller 341 is higher than the actual situation, i.e., more low-frequency content have been cut. If the sign of the correction factor is positive, then it means that the risk level predicted in the first fuzzy logic controller 341 is lower than the actual situation, i.e., more low-frequency content should be cut in order to keep the speaker excursion away from the danger limit. The Risk Level can be adjusted as follow:

$$RL=RL+N*PE$$

where N is a coefficient that can be selected in the system or as an input to the system.

In some embodiments, the adjusted risk level as described above can be used to vary the audio output signal to control speaker excursion. Referring to FIG. 3A, audio system 300 has an adjustment unit 347 configured to receive the risk level 343 and the correction factor 345 to provide a control signal 349 to digital signal processing unit 305 in signal processor 310 for adjusting the audio output signal 308.

In a speaker excursion control system, the low-frequency content loss ratio (LFLR) and the signal to the noise and distortion ratio (SNDR) of the speaker are the two main considerations of the control system performance. These quantities can be defined as follows. It is assumed that the average power of the input signal which has passed a Low Pass Filter with a 200 Hz cut off frequency is Pa, and that the average power of the output signal which has passed a Low Pass Filter with a 200 Hz cut off frequency is Pb. The Low Frequency content loss ratio (LFLR) can be defined as:

$$LFLR=100\%*(Pa-Pb)/Pa$$

The signal to the noise and distortion ratio (SNDR) can be defined as:

$$SNDR=P(\text{signal})+P(\text{noise})+P(\text{distortion})/(P(\text{noise})+P(\text{distortion}))$$

A simulation test was performed to verify the effectiveness of the fuzzy logic used in the speaker excursion control model described above. In the simulation test, as a clip of music is playing through a speaker, the spectrogram of the music are recorded under three different conditions:

A. with no protection method,

B. with simple high pass filter protection, and

C. with the proposed speaker excursion control algorithm.

The spectrograms of the three cases are compared. The result shows that although a simple high pass filter can keep the speaker excursion away from the danger limit, the distortion of the music is severe since too much low-frequency content have been cut off. The distortion introduced by the proposed algorithm was minimal when comparing the spectrogram of the original input with the protected input.

Figure 10:
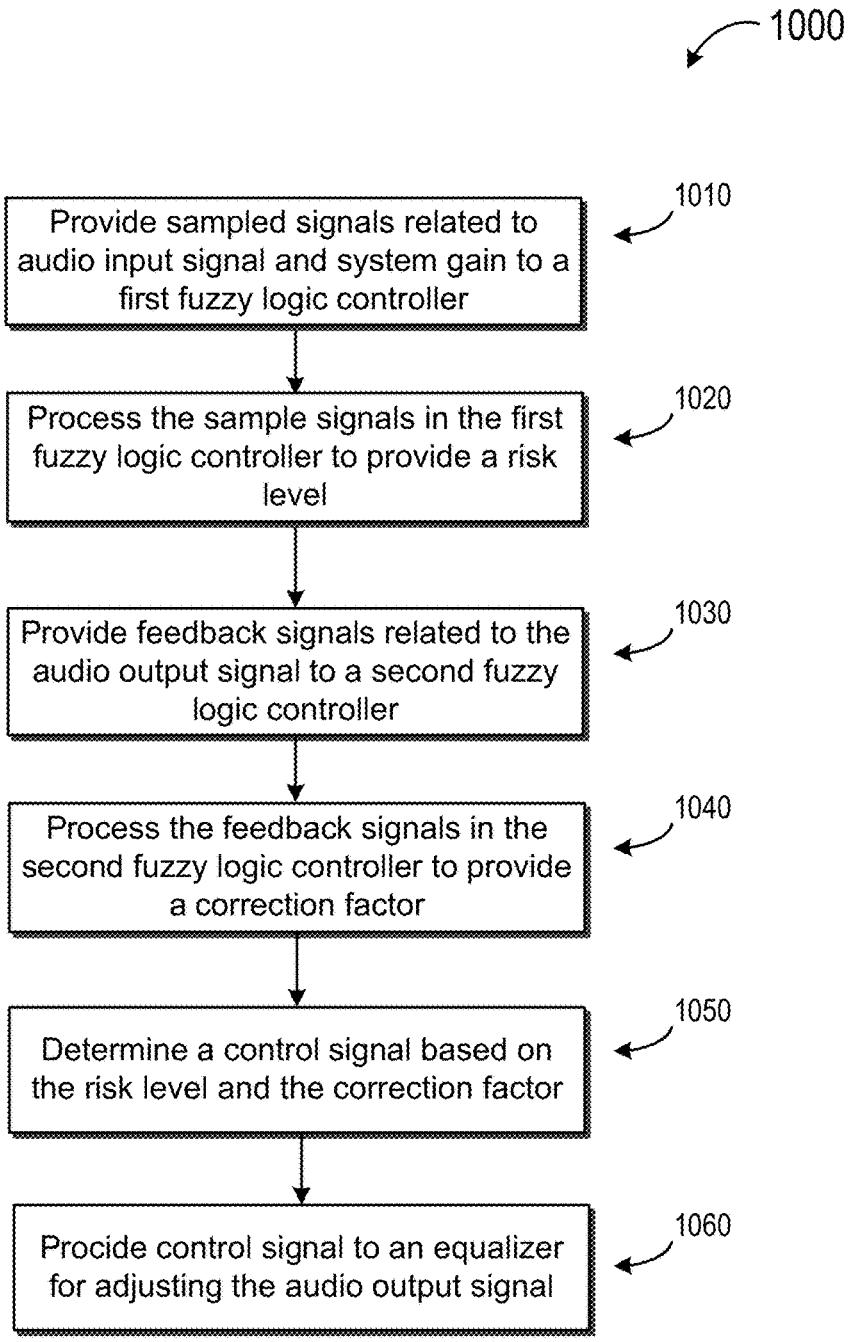
FIG. 10 is a simplified flowchart illustrating a method for speaker control according to some embodiments of the present invention.

FIG. 10 is a simplified flowchart illustrating a method for speaker control according to some embodiments of the present invention. As shown in FIG. 10, method 1000 is a method for speaker control, for example, speaker excursion control, in an audio system configured to receive an audio input signal and provide an audio output signal to a speaker. The method includes providing sampled signals related to the audio input signal and a gain of the audio system to a first fuzzy logic controller (1010). The sampled signals are processed in the first fuzzy logic controller to provide a risk level associated with the speaker (1020). The method also includes providing feedback signals related to the audio output signal to a second fuzzy logic controller (1030). The feedback signals are processed in the second fuzzy logic controller to provide a correction factor (1040). The method also includes determining a control signal based on the risk level and the correction factor (1050). The control signal is then provided to the audio system for adjusting the audio output signal (1060). In some embodiments, method 1000 in FIG. 10 can be implemented with the audio system described above in connection with FIGS. 3A, 3B, to FIG. 9.

Although specific embodiments of the invention are described above, the description should not be taken as limiting the scope of the invention. It is understood that the examples and embodiments described herein are for illustrative purposes only and that various modifications or changes can be made in light thereof.

What is claimed is:

1. An audio system for loudspeaker excursion control, comprising:

an input node for receiving an audio input signal;

an output node for providing an audio output signal;

a signal processor for receiving the audio input signal and providing the output audio signal, the signal processor including:

an analog-to-digital converter (ADC);

a digital signal processing unit;

a digital-to-analog converter (DAC);

an audio amplifier; and a speaker;

a low-frequency and gain sampling unit for providing a low-frequency component of the audio input signal and a current gain of the audio system;

a feedback sampling unit for providing a feedback current signal and a feedback voltage signal derived from the output node;

a first fuzzy logic controller configured to receive the low-frequency component of the audio input signal and the current gain of the audio system, and to determine a risk level of the audio output signal with respect to speaker excursion;

a second fuzzy logic controller configured to receive the feedback voltage signal and the feedback current signal, and to determine a correction factor;

wherein the audio system is configured to:

determine a control signal based on the risk level and the correction factor; and provide the control signal to the signal processor for adjusting the audio output signal.

2. The audio system of claim 1, wherein the low-frequency and gain sampling unit comprises a low-frequency sampling unit and a gain sampling unit.

3. The audio system of claim 2, wherein the low-frequency sampling unit comprises a low-pass filter to determine a low-frequency component of the audio input signal, and the low-frequency sampling unit is configured to compute a short-term power of the low-frequency component, a long-term power of the low-frequency component, and a deviation of the low-frequency component that is a difference between the short-term power and the long-term power of the low-frequency component.

4. The audio system of claim 2, wherein the gain sampling unit is configured to:

determine gain values of a DAC (Digital-to-Analog Converter) in the signal processor; and compute a short-term power of gain values, a long-term power of gain values, and a deviation of gain values which is a difference between the short-term power of gain values and the long-term power of gain values.

5. The audio system of claim 1, wherein the feedback sampling unit further comprises:

a voltage sensing circuit configured to measure a voltage provided to the speaker; and a current sensing circuit configured to measure a current provided to the speaker.

6. The audio system of claim 1, wherein the control signal is related to a sum of the risk level and the correction factor weighted by a weighting factor.

7. An audio system, comprising:

an input node for receiving an audio input signal;

a signal processor coupled to the input node to receive the audio input signal;

an output node for providing an audio output signal to a speaker;

a first fuzzy logic controller configured to receive sampled signals related to the audio input signal and a gain of the signal processor, the first fuzzy logic controller configured to determine a risk level of the audio output signal;

a second fuzzy logic controller configured to receive feedback signals related to the audio output signal and to determine a correction factor;

wherein the audio system is configured to:

determine a control signal based on the risk level and the correction factor; and provide the control signal for adjusting the audio output signal.

8. The audio system of claim 7, further comprising a low-frequency and gain sampling unit that includes a low-frequency sampling unit and a gain sampling unit.

9. The audio system of claim 8, wherein the low-frequency sampling unit comprises a low-pass filter to determine a low-frequency component of the audio input signal, and the low-frequency sampling unit is configured to compute a short-term power of the low-frequency component, a long-term power of the low-frequency component, and a deviation of the low-frequency component that is a difference between the short-term power and the long-term power of the low-frequency component.

10. The audio system of claim 8, wherein the gain sampling unit is configured to:

determine gain values of a DAC (Digital-to-Analog Converter) in the signal processor; and compute a short-term power of gain values, a long-term power of gain values, and a deviation of gain values which is a difference between the short-term power of gain values and the long-term power of gain values.

11. The audio system of claim 7, wherein the feedback signals comprise signals related to feedback voltage and feedback current.

12. The audio system of claim 11, further comprising a current sensing circuit configured to measure a current provided to the speaker.

13. The audio system of claim 11, wherein further comprising a voltage sensing circuit configured to measure a voltage provided to the speaker.

14. The audio system of claim 7, wherein the control signal is related to a sum of the risk level and the correction factor weighted by a weighting factor.

15. A method for speaker control in an audio system configured to receive an audio input signal and provide an audio output signal to a speaker, the method comprising:

providing sampled signals related to the audio input signal and a gain of the audio system to a first fuzzy logic controller;

processing the sampled signals in the first fuzzy logic controller to provide a risk level associated with the speaker;

providing feedback signals related to the audio output signal to a second fuzzy logic controller;

processing the feedback signals in the second fuzzy logic controller to provide a correction factor;

determining a control signal based on the risk level and the correction factor; and providing the control signal to the audio system for adjusting the audio output signal.

16. The method of claim 15, wherein providing sampled signals comprises:

determining a low-frequency component of the audio input signal using a low-pass filter; and computing a short-term power of the low-frequency component, a long-term power of the low-frequency component, and a deviation of the low-frequency component that is a difference between the short-term power and the long-term power of the low-frequency component.

17. The method of claim 15, wherein providing sampled signals comprises:

determining a gain of a DAC (Digital-to-Analog Converter) in the audio system; and computing a short-term power of the gain, a long-term power of the gain, and a deviation of the gain that is a difference between the short-term power of the gain and the long-term power of the gain.

18. The method of claim 15, wherein providing feedback signals comprises providing signals related to feedback voltage and feedback current.

19. The method of claim 18, further comprising using a current sensing circuit to measure a current in the audio output signal to the speaker.

20. The method of claim 18, further comprising using a voltage sensing circuit to measure a voltage in the audio output signal to the speaker.

* * * * *